United States Patent [19]

Chandler, Jr. et al.

[11] Patent Number: 4,835,983

[45] Date of Patent: Jun. 6, 1989

[54] KIOSK WITH AIR CONDITIONING

[75] Inventors: Rupert P. Chandler, Jr., Stuarts Draft; Fred R. McDavid, Harrisonburg; Jimmie D. Lough, Verona; Gary E. Dove, Waynesboro, all of Va.

[73] Assignee: Hopeman Brothers, Inc., Waynesboro, Va.

[21] Appl. No.: 220,469

[22] Filed: Aug. 10, 1988

[51] Int. Cl.[4] ..... F25D 23/12

[52] U.S. Cl. ..... 62/259.1; 62/261; 62/440; 62/449; 62/DIG. 16; 98/31

[58] Field of Search ..... 62/449, 454, 455, 261, 62/DIG. 16, 440, 259.1; 98/31; 165/48.1

[56] References Cited

U.S. PATENT DOCUMENTS

| | | | |
|---|---|---|---|
| 2,247,028 | 6/1941 | Kuntz | 62/261 |
| 2,963,881 | 12/1960 | Stark | 62/261 X |
| 3,031,862 | 5/1962 | Sherron | 62/449 X |
| 3,263,438 | 8/1966 | Maudlin | 62/259.1 X |
| 3,611,907 | 10/1971 | Wasserman et al. | 98/31 X |
| 4,732,012 | 3/1988 | Thorpe | 62/DIG. 16 |

*Primary Examiner*—Lloyd L. King

*Attorney, Agent, or Firm*—Howson & Howson

[57] ABSTRACT

An air conditioning kiosk for human occupants and automatic teller machines or the like. Intake and exhaust compartments hidden beneath the roof communicate with the outside through openings in a recessed coving. A conventional vapor compression, room air conditioner, mounted beneath the intake compartment draws outside air for cooling the conditioner's condenser, and discharges the air to the exhaust compartment. Air drawn from the interior of the kiosk is cooled by the conditioner's evaporator and recirculated. A fan in the intake compartment maintains a continuous supply of fresh air at a positive pressure in the kiosk.

25 Claims, 4 Drawing Sheets

34
48
3
70
32
36
30
38
54
24
31
28b
50
55
27
26
3
51
76
32
28a
16a
16a
16b
80
16a
16b
18
17
16c
16a
16c
16b

KIOSK WITH AIR CONDITIONING

BACKGROUND OF THE INVENTION

The present invention relates to cabinet structures, and more particularly to a kiosk with air conditioning for human occupants and automatic teller machines or other environmentally sensitive equipment.

Kiosks with environmental control systems have used off-the-shelf, self-contained room air conditioners mounted in an outside wall or window. Others have specially designed air conditioners fully contained within the kiosk, but these usually require louvered ventilators somewhere on the exterior of the kiosk for receiving and discharging outside air needed to cool the air conditioner's condenser coils. The louvers are generally noisy and detract from the plain exterior and clean appearance of the kiosk. In outdoor environments, prevailing winds blowing into the discharge ventilators may also cause a back pressure in the air conditioner and prevent sufficient cooling air from passing over the condenser coil. To blunt the wind, a sheet metal shroud or baffel has been added in some designs. The shroud projects outwardly from the louvers further detracting from the smooth profile of the kiosk.

Other kiosks have used a "split" vapor compression air conditioning system in which the evaporator unit for cooling the kiosk air is located inside the kiosk, and the condenser unit for cooling the refrigerant is mounted outside on the roof or ground nearby. The split system avoids noisy and unsightly louvered ventilators, but introduces other problems associated with hiding and protecting the condenser unit.

SUMMARY OF THE INVENTION

Accordingly, it is an object of the present invention to provide a kiosk for housing human occupants and automatic teller machines or the like, which is suitable for use with a conventional, self-contained air conditioner.

Another object of the invention is to provide an outdoor type of enclosure for use with an off-the-shelf room air conditioner in which the intake and exhaust ventilators for air flow through the air conditioner are secluded within the confines of a plain exterior, in which air flow through the air conditioner is not impeded by prevailing winds, and in which the air conditioner can be easily removed and replaced with another without modifications to the enclosure.

A further object of the invention is to provide an environmentally controlled enclosure in which fresh air is continuously maintained within at a positive pressure.

A still further object of the invention is to provide an enclosure for environmental control which uses standard, commercially available components, which is relatively easy to manufacture, assemble and maintain, and which allows easy access for maintenance and repair of equipment contained therewithin.

Briefly, these and other objects of the invention are accomplished with an all-weather, free-standing enclosure having a hidden ceiling plenum beneath the roof divided into intake and exhaust compartments which communicate with an air conditioner mounted in the enclosure. The air conditioner is a self-contained unit utilizing a conventional vapor compression system with outside air for cooling the condenser. The cooling air is drawn from the intake duct, and the heated air discharged through a booster blower into the exhaust duct.

The air cooled by the evaporator is recirculated within the enclosure. Recessed coving having grid openings around the perimeter of the intake and exhaust compartments provides passages to and from the outside. A fan at the intake compartment maintains a continuous supply of fresh air at a positive pressure to the enclosure even when the air conditioner is not running. Styrofoam and hardboard paneling beneath the compartments and within the walls of the enclosure provide both sound and heat insulation.

For a better understanding of these and other objects and aspects of the invention, reference may be made to the following detailed description taken in conjunction with the accompanying drawings wherein:

DESCRIPTION OF THE PREFERRED EMBODIMENT

Figure 3:
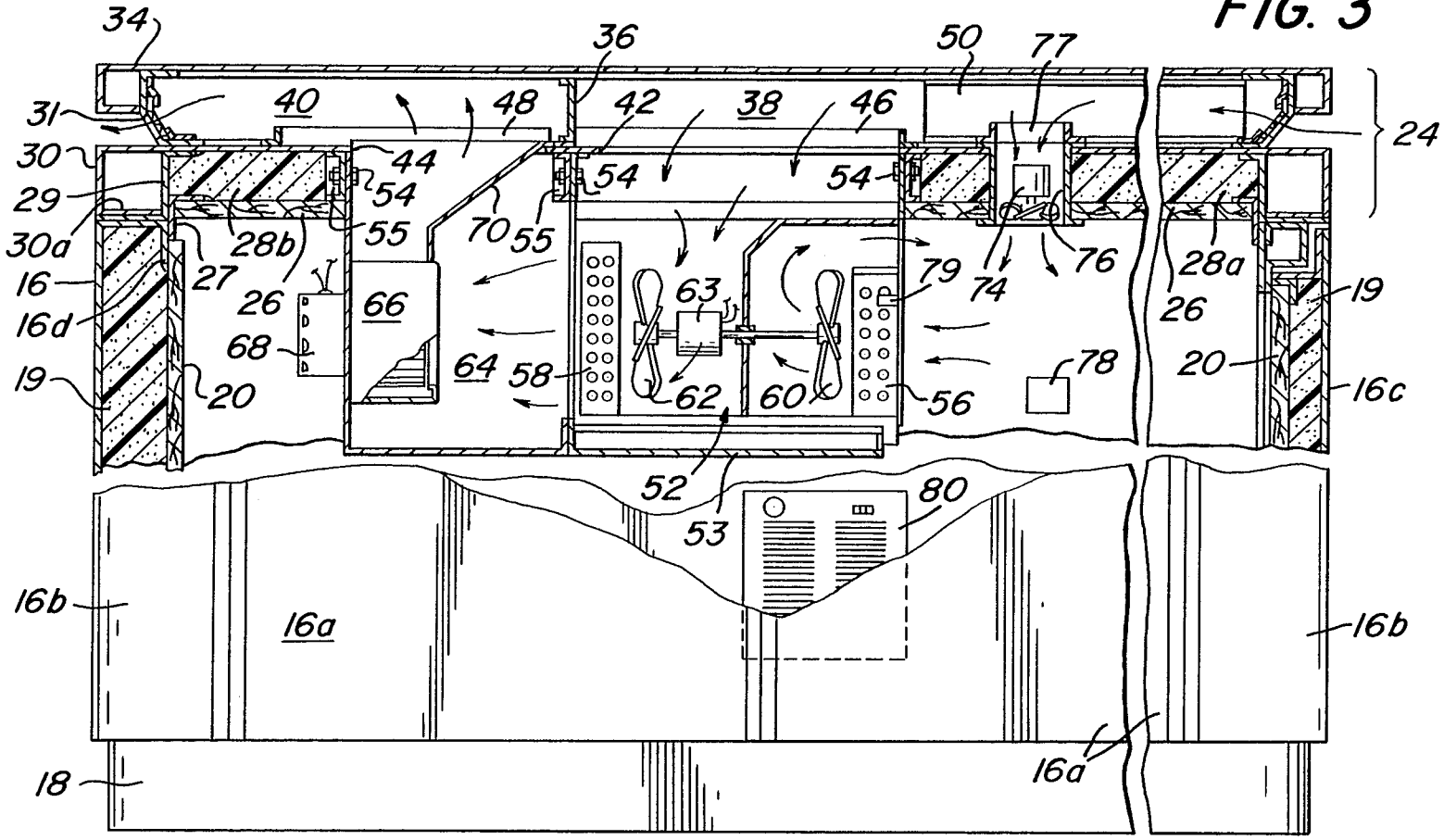
FIG. 3 is an elevation view of the kiosk partially in cross section along the line 3—3 of FIG. 2.

Referring now to the drawings wherein like characters designate like or corresponding parts throughout the several views, there is shown a freestanding kiosk 10 securely mounted on a platform 12 and of a size suitable for housing a drive-up automatic teller machine or ATM 14 of any conventional design. Kiosk 10 includes flat front, rear and side panels **16*a*, quarter-round corner panels 16*b*, and flat front and side doors 16*c*, all of equal height, connected along their sides to the adjacent panels and along the bottom to a foundation 18 to form a rectangular enclosure with flush exterior surfaces. The panels are preferrably constructed of steel sheets and joined to each other by spring clips. The seams are sealed by caulking and snap-in plastic trim, not shown. A pair of openings 18*a* are provided in foundation 18 for access by a forklift. One of the front panels 16*a* includes a cutout 17 permitting access to a user terminal of ATM 14; and doors 16*c* are hinged along one side to afford access to the equipment for servicing. Referring to FIG. 3, the edges of panels 16*a* and doors 16*c* are formed into inwardly projecting rims 16*d* to which hardwood panels 20 are spatially secured for structural rigidity. High density, resinous rigid-foam sheets 19 are bonded between the panels 16*a* and doors 16*c* and paneling 20** for thermal and acoustic insulation.

The top of kiosk 10 is enclosed by a ceiling assembly 24 built up from a hardwood panel 26, insulator sheets **28*a* and 28*b*, coaming 29, a ceiling pan 30, coving 31, and a roof 34. The peripheries of pan 30 and roof 34 coincide with the external sides of the panels and doors to form a congruent enclosure. Coaming 29, such as of preformed sheet metal, is secured along the top of panels 16*a*, 16*b* and 16*c* and recessed to provide a raised border to fit tightly within a flanged rim 30*a* of pan 30. A continuous coving 31 is recessed between pan 30 and roof 34 about their periphery and includes grids 32** along the front and two sides to form therewith a ceiling plenum freely communicating with the outside air.

Other grid locations in coving 31 are contemplated such as only in the rear coving 31 in order that grids 32 may be completely hidden from ATM users' view.

Figure 4:
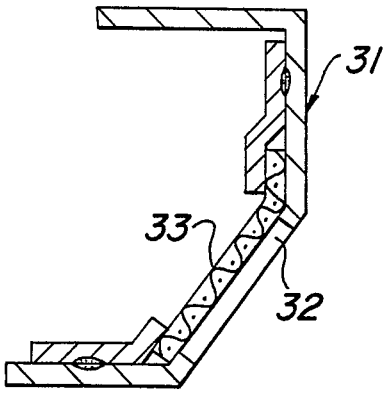
FIG. 4 is an enlarged elevation view of a top portion of the kiosk in cross section.

The plenum is divided by a channel bar 36 extending between the front and rear sections of coving 31 into air intake and exhaust compartments 38 and 40 which communicate with the space below pan 30 by way of intake and exhaust openings 42 and 44. Insulating sheets 28*a* and 28*b* beneath respective compartments 38 and 40, such as of a resinous rigid foam material, are supported by angles 27 and panel 26. Angles 27 are preferrably riveted to the rims 16*d* and coaming 29 and project inwardly. Dams 46 and 48 around openings 42 and 44 keep any rain water which may collect in the plenum through grids 32 from running into the space below pan 30. A pair of diverging channel bars 50 fixed to pan 30 within intake compartment 38 stiffen the ceiling assembly 24 and improve the distribution of intake air. As illustrated in FIG. 4, a screen backing 33 behind grids 32 of coving 31 prevents finer particles and insects from entering the kiosk.

A self-contained air conditioner 52 is removably mounted beneath intake opening 42 within a housing 53 held by fasteners 54 to cross channels 55 which, in turn, are fixed at their ends to the front and rear coaming 29 at the opposite sides of openings 42 and 44. Air conditioner 52 is of conventional design, such as a Climette® Model KC212HA Room Air Conditioner manufactured by Climette of Ontario, Canada, utilizing a vapor compression refrigeration cycle. It includes an evaporator 56 and a condenser 58 in separated compartments connected in series between a compressor and expansion valve (not shown), and fans 60 and 62, driven on a common shaft by an electric motor 63. Fan 60 recirculates air cooled by evaporator 56 through the interior of kiosk 10 while fan 62 draws outside air from intake compartment 38 to condenser 58. When the Climette room air conditioner is used, the cabinet, enclosing, its condenser compartment and normally ventilated on the sides, is removed to allow unrestricted flow from above of cooling air to the condenser 58; and its exhaust damper is closed to prevent the air in kiosk 10 from exhausting through condenser 58 to the outside. The air heated in passing over condenser 58 passes through a chamber 64 in housing 53 to the inlet of a booster blower 66, driven by an electric motor 68, and then discharges through a transition duct 70 in opening 44 to the outside.

An electric fresh air fan 74 mounted within a bypass duct 76 in paneling 27, insulator sheet 28*a* and pan 30 draws air from intake duct 38 for maintaining a continuous supply of fresh air under positive pressure within the kiosk 10. A dam 77 around bypass duct 76 keeps any rain water collected in duct 38 from running into the space below pan 30.

For colder climatic conditions, a self-contained, thermostatically-controlled electric wall heater 80, shown centrally positioned within the kiosk 10 in FIG. 3, maintains the inside of the enclosure above a selected temperature such as 60° F.

Figure 1:
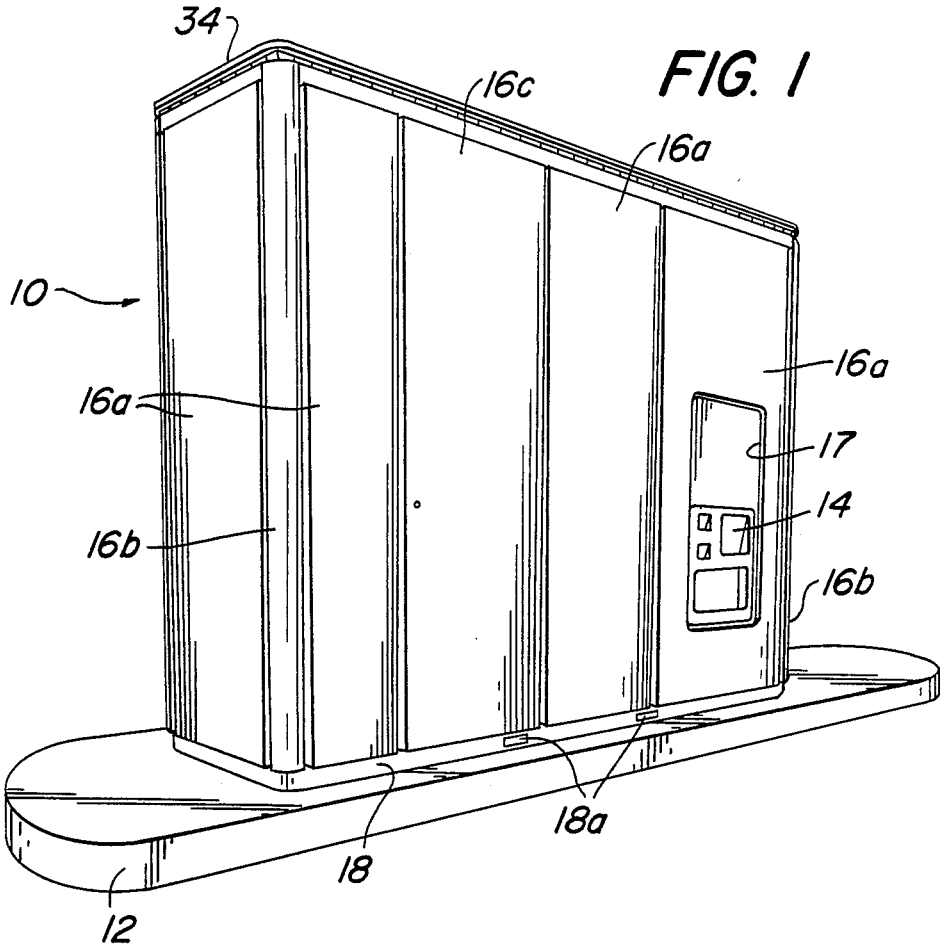
FIG. 1 is a perspective view of a kiosk according to the invention as applied to an automatic teller machine.
Figure 2:
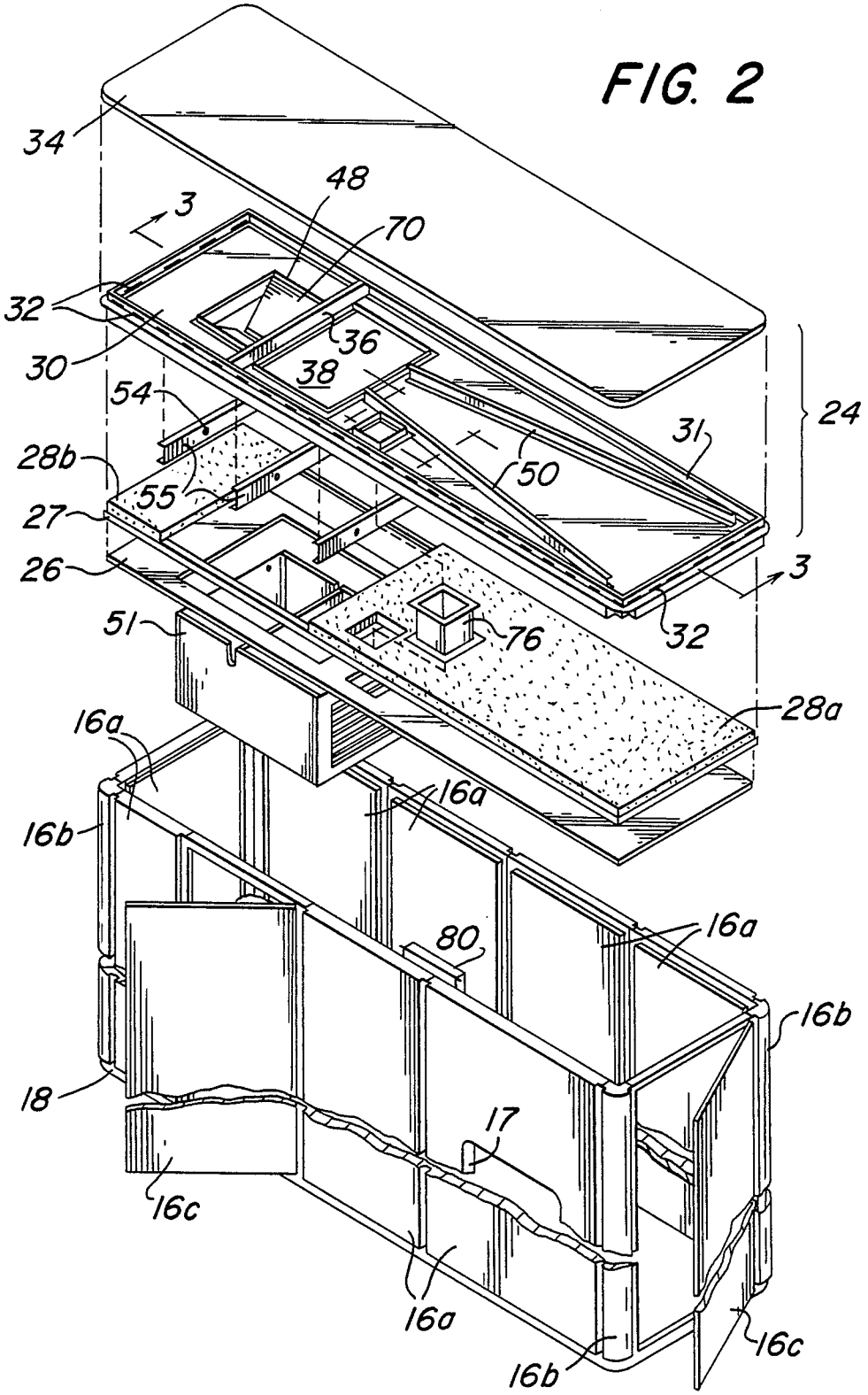
FIG. 2 represents an exploded, isometric view of the kiosk of FIG. 1.
Figure 5:
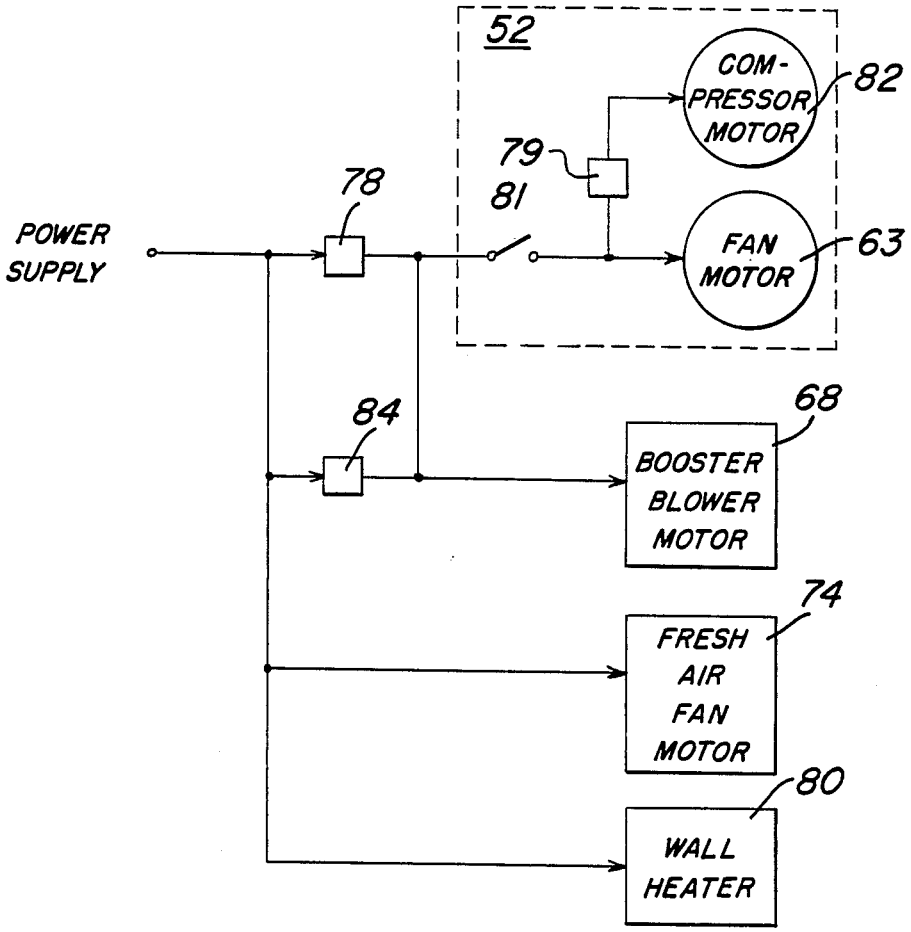
FIG. 5 is an electrical schematic diagram of components within the kiosk.

Referring now to the electrical schematic diagram in FIG. 5, when the kiosk 10 is in service, electrical power is furnished at all times to run fresh air fan 74. This maintains the space within the kiosk 10 at a positive air pressure during periods when air conditioner 52 is not operating. Cooling within the kiosk 10 is controlled automatically by two series-connected thermostats 78 and 79. Thermostat 78, with its sensor located within the interior of the kiosk 10, energizes the booster blower motor 68 and a manual power switch 81 within air conditioner 52 whenever the temperature within the kiosk exceeds a selected set point, for example 65° F. Thermostat 79, with its sensor located at the air inlet to evaporator 56 energizes the air conditioner's coolant compressor 82 (not shown in FIGS. 1–3) whenever the return air temperature exceeds a selected level above the setting of thermostat 78, such as 70° F. With thermostat 78 calling for cooling and switch 81 normally closed, fan motor 63 is energized whereby kiosk air is now recirculated over evaporator 56 and outside air passed over condenser 58. When the temperature at thermostat 79 exceeds its set point, the compressor motor 82 is energized circulating refrigerant through the vapor compression system including evaporator 56 and condenser 58.

A manually operated timer switch 84, wired in parallel with thermostat 78, will also energize blower 68 and provide power to switch 81 for a selected duration. This allows one to override thermostat 78 and turn on the air conditioner for human comfort during servicing and maintenance of the equipment. Wall heater 86, is also energized through its own thermostat, not shown, directly from the power supply.

Some of the many advantages and novel features of the invention should now be readily apparent. For example, a kiosk configuration with a plain, unobstructed exterior is provided for use with a conventional vapor-compression type air conditioner completely contained therein. The air intake and exhaust ventilators for receiving and discharging outside air needed to cool the conditioner's condenser are completely secluded beneath the roof edge while also affording unimpeded air flow over the condenser regardless of external wind conditions. A temperature control system is provided which is fully automatic but with manual override. Positive pressure is maintained within the kiosk at all times it is in service. The kiosk is particularly accessible for ease of installation, removal and maintenance of off-the-shelf, commercially available, room-type air conditioners.

It will be understood that various changes in the details, steps and arrangement of parts, which have been herein described and illustrated in order to explain the nature of the invention, may be made by those skilled in the art within the principle and scope of the invention as expressed in the appended claims.

What is claimed is:

1. An air conditioned enclosure, comprising, in combination:

a base for supporting said enclosure;

upright panel means having a flat exterior with a lower border attached to said base around the perimeter thereof, and an upper border;

ceiling means connected to the upper border and across the top of said panel means and having a perimeter substantially flush with the exterior for enclosing a space within said panel means;

roof means disposed in spaced relation above said ceiling means and having a perimeter substantially flush with the exterior;

coving means secured between said ceiling means and said roof means and recessed within the perimeters thereof, and including a grid along a selected portion of said coving forming thereby a ventilated plenum;

divider means connected between said ceiling means and said roof means across said plenum forming thereby separate ventilated intake and exhaust compartments; and a vapor compression air conditioner means having a condenser and evaporator with separate air ducts therethrough, said conditioner supported beneath said ceiling means with said air inlet and outlet ducts of said condenser communicating with respective ones of said intake and exhaust compartments, and with said air inlet and outlet ducts of said evaporator communicating with said space.

2. An enclosure according to claim 1, further comprising:

bypass means operatively connected to said intake duct for maintaining a positive pressure within said space.

3. An enclosure according to claim 2, wherein:

said bypass means includes a bypass duct formed in said ceiling means communicating between said intake duct and said space, and a blower operatively connected to said bypass duct.

4. An enclosure according to claim 3, wherein:

said ceiling means includes a pan coextensive with said exterior, and watertight barriers extending above said pan around said condenser air inlet and outlet ducts and said bypass duct.

5. An enclosure according to claim 1, further comprising:

booster means operatively connected between said condenser outlet duct and said exhaust compartment for inducing air flow therethrough.

6. An enclosure according to claim 5, wherein:

said booster means includes a blower.

7. An enclosure according to claim 1, wherein:

said coving includes an open grating for passing air therethrough, and a screen across said grating for filtering out particles above a predetermined size.

8. An enclosure according to claim 1, further comprising:

said ceiling means includes a pan coextensive with said exterior, and coaming extending below a recessed rim of said pan and connected to the upper border of said panel means.

9. An enclosure according to claim 8, further comprising:

support members fixed at their ends across said space to opposed coaming members and secured to said air conditioner means.

10. An enclosure according to claim 1, wherein:

said ceiling means further includes watertight barriers extending above said pan around said condenser air inlet and outlet ducts.

11. A kiosk for use with a self-contained vapor-compression air conditioner of the type including a compressor, condenser, expansion valve and evaporator connected in series with separate passages for cooling and recirculating air, and comprising, in combination: a rectangular base;

upright rectangular panels of uniform height and having flat exterior sides attached to each other in side-by-side relation around the perimeter of said base;

a ceiling pan connected to the top of said panels, the perimeter of said ceiling pan being substantially flush with the exterior side of said panels;

coving connected around the top of and recessed within the perimeter of said ceiling pan, said coving including grid openings along a selected portion thereof;

a roof connected across the top of said coving in spaced relation to said ceiling pan and having a perimeter substantially flush with the exterior sides of said panels forming thereby a ventilated plenum;

a divider connected between said panel and said roof for dividing said plenum into intake and exhaust compartments;

support means formed to mount the air conditioner beneath said ceiling pan; and duct means formed to communicate between said intake and exhaust compartment and said condenser passage.

12. An enclosure according to claim 11, further comprising:

a bypass means formed in said ceiling means communicating between said intake compartment and the space below said ceiling pan, and including a blower for inducing air flow through said bypass means.

13. An enclosure according to claim 12, further comprising:

watertight barriers extending above said pan around said duct means.

14. An enclosure according to claim 11, further comprising:

blower means operatively connected in the cooling passage for inducing air flow therethrough.

15. An enclosure according to claim 11, wherein:

said coving further includes a screen across said openings for filtering out particles above a predetermined size.

16. An enclosure according to claim 11, further comprising:

said ceiling pan includes coaming extending below a recessed rim of said pan.

17. An enclosure according to claim 16, wherein:

said support means includes rigid members fixed at their ends to opposed coaming members for securing to the air conditioner.

18. An air conditioned kiosk for an automatic teller machine, comprising, in combination:

a rectangular base;

flat upright panels attached to each other in side-by-side relation and at the lower ends thereof to the perimeter of said base to form an enclosure congruent with said base;

a flat ceiling pan connected to said panels across the top of said enclosure and substantially flush with the external surface of said panels;

a continuous coving connected to said pan along the top and recessed from the perimeter thereof;

a flat roof connected said coving across the top thereof and having a perimeter substantially flush with the external surfaces of said panels forming thereby a plenum;

a divider connected between said pan and said roof dividing said plenum into an intake duct and an exhaust duct; and a vapor compression type air conditioner including a condenser and evaporator and supported beneath said pan, said condenser communicating with said intake and exhaust ducts for circulating air therethrough, and said evaporator communicating with the interior of said enclosure for circulating air therethrough.

19. An air conditioned housing, comprising in combination:

upright panel means forming an enclosure with smooth exterior sides;

plenum means disposed across the top of said enclosure having a perimeter substantially flush with said sides, said plenum means further including a divider forming intake and exhaust compartments and a recessed coving around the perimeter for ventilating said compartments; and air conditioner means depending from said plenum means and having an air inlet and air outlet duct beneath said plenum means communicating with respective ones of said compartments.

20. A housing according to claim 19, further comprising:

bypass means operatively connected to said intake compartment for maintaining a positive pressure within said enclosure.

21. A housing according to claim 20, wherein:

said plenum means includes a pan coextensive with said exterior, and a watertight barrier extending above said pan around said inlet, outlet and said bypass ducts.

22. An enclosure according to claim 19, further comprising:

booster means operatively connected to said air conditioner means for inducing air flow therethrough.

23. A housing according to claim 19, wherein:

said coving includes an open grid for passing air therethrough, and a screen across said grid for filtering out particles above a predetermined size.

24. A housing according to claim 19, further comprising:

said plenum means includes a pan coextensive with said exterior sides, and coaming members extending below a recessed perimeter of said pan and connected to the upper border of said panel means.

25. An enclosure according to claim 24, further comprising:

elongated support members fixed at the ends thereof across said space to opposed coaming members for securing to the air conditioner.

* * * * *